US006322244B1

(12) United States Patent
Marchesini et al.

(10) Patent No.: US 6,322,244 B1
(45) Date of Patent: Nov. 27, 2001

(54) MIXER WITH TWO-PART RADIAL BLADES

(75) Inventors: Vainer Marchesini, S. Prospero; Lamberto Vincenzi, Staggia Di S. Prospero, both of (IT)

(73) Assignee: WAM S.p.A., Ponte Motto Cavezzo (IT)

( * ) Notice: Subject to any disclaimer, the term of this patent is extended or adjusted under 35 U.S.C. 154(b) by 0 days.

(21) Appl. No.: 09/538,234

(22) Filed: Mar. 30, 2000

(30) Foreign Application Priority Data

Apr. 30, 1999 (IT) ..... MO99A0088

(51) Int. Cl.[7] ..... B01F 7/04

(52) U.S. Cl. ..... 366/325.5; 366/319; 366/325.1; 366/329.1

(58) Field of Search ..... 366/3.19, 329.1, 366/325.2, 325.1, 325.4, 325.5, 168.1, 325.92, 327.1, 327.2, 13

(56) References Cited

U.S. PATENT DOCUMENTS

| | | | |
|---|---|---|---|
| 3,293,118 | | 12/1966 | Putnam et al. . |
| 3,652,062 | | 3/1972 | Baker . |
| 4,091,457 | * | 5/1978 | Slywka . |
| 4,230,615 | | 10/1980 | Crocker et al. . |
| 4,449,826 | * | 5/1984 | Mathis et al. . |
| 4,622,152 | | 11/1986 | Resing et al. . |
| 4,909,634 | | 3/1990 | Suzuki et al. . |
| 5,707,145 | | 1/1998 | Lücke et al. . |
| 5,899,568 | * | 5/1999 | Vonnahme . |

FOREIGN PATENT DOCUMENTS

| | | |
|---|---|---|
| 658 798 | 12/1986 | (CH) . |
| 673 595 | 3/1990 | (CH) . |
| 3635877 | 10/1987 | (DE) . |
| 0 063 171 | 7/1981 | (EP) . |
| 793457 | 4/1958 | (GB) . |
| 98/48928 | 11/1998 | (WO) . |

* cited by examiner

*Primary Examiner*—Joseph W. Drodge
*Assistant Examiner*—Terry K. Cecil
(74) *Attorney, Agent, or Firm*—Browdy and Neimark

(57) ABSTRACT

A mixer for mixing loose powder, granular and liquid materials includes a mixing chamber 8 having a rotatable shaft 4 therein. The shaft bears a plurality of radial blades for agitating the materials. Each of the radial blades 13 includes a wedge-shaped first part 14 and a second part 15 connected thereto. The first part includes a thin-edged front end 140 for penetrating the materials and the second part includes a frontal end 150 for impacting the materials. As a result, the mixer produces a high degree of homogenization with a relatively low degree of energy consumption.

5 Claims, 3 Drawing Sheets

150
151
140
150
151
F
14
15

15
152
150
140
F
150
14
152
151

MIXER WITH TWO-PART RADIAL BLADES

BACKGROUND OF THE INVENTION.

Specifically, though not exclusively, the invention is useful for mixing a mixture of solid loose materials, in powder or granular form, which may be mixed with a liquid.

Reference is particularly made to a mixer comprising a mixing chamber, having at least one inlet and one outlet for the material, internally of which chamber there is a rotor shaft bearing a plurality of radial blades for agitating the material.

1. Technical Field of the Invention

A mixer of this type is already known, in which the blades are normally arranged coaxially about a rotating shaft and extend radially to the shaft.

2. Prior Art

Known mixers of the above type are susceptible to improvement both in terms of homogenization of the mixture obtained and in terms of operative speed.

OBJECT OF THE INVENTION

The main aim of the present invention is to provide a mixer by means of which a much more homogeneous mixture can be obtained and faster than with known-type mixers.

An advantage of the invention is that it provides a mixer which is constructionally simple and economical.

A further advantage is that a mixer is obtained which can provide a high degree of homogenization of the various components of the mixture, with a relatively low energy consumption.

A further advantage is that the invention provides a mixer with short axial length and being therefore relatively small.

SUMMARY OF THE INVENTION

The mixer of the invention comprises a mixing chamber, having at least one inlet and one outlet for the material, internally of which chamber there is a rotor shaft bearing a plurality of radial blades for agitating the material.

BRIEF DESCRIPTION OF THE DRAWINGS

These aims and advantages and others besides are all attained by the invention as it is characterised in the claims that follow.

Further characteristics and advantages of the present invention will better emerge from the detailed description that follows of a preferred but non-exclusive embodiment of the invention, illustrated purely by way of non-limiting example in the accompanying figures of the drawings, in which.

DESCRIPTION OF THE PREFERRED EMBODIMENTS

Figure 1:
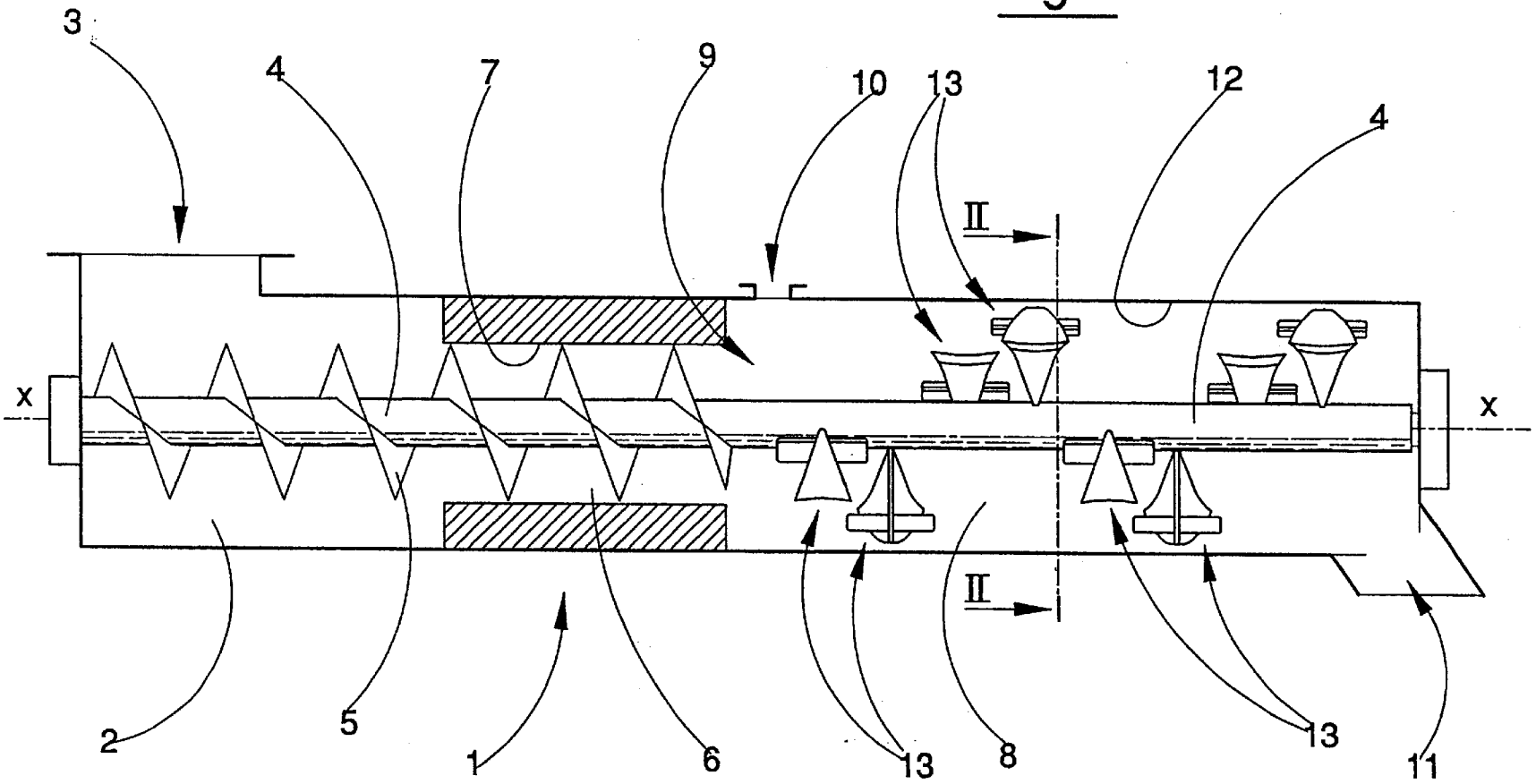
FIG. 1 shows a schematic longitudinal section, in vertical elevation, of a mixer according to the invention.
Figure 2:
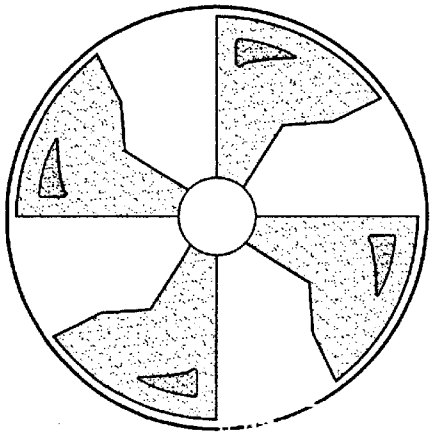
FIG. 2 is a section made according to line II—II of FIG. 1.

With reference to the figures of the drawings, 1 denotes in its entirety a mixer, usable for mixing pasty material or solid loose material in powder or granular form. The mixer is especially useful for producing amalgams having a controlled viscosity, formed by one or more solid loose materials amalgamated with one or more liquids.

The mixer 1 comprises a material extraction chamber 2, which is cylindrical and has a horizontal axis x-x, an inlet mouth 3 corrected to the lower outlet of a hopper (of known type and not illustrated) for infeeding the solid loose materials in granular and/or powder form. A rotatable shaft 4 is predisposed internally of the mixer 1; the shaft 4 can be commandably rotated about a horizontal axis x-x thereof. An arrow F indicates a rotation direction of the shaft 4. The shaft 4 externally bears a coaxial spiral 5 operating internally of the extraction chamber 2. By effect of the rotation of the shaft 4, the spiral 5 extracts the powder or granular material from the bottom of the hopper and sends it on to a material batching chamber 6 arranged downstream of the extraction chamber 2 and being coaxial thereto. The batching chamber 6 is in fact an extension of the extraction chamber 2. The spiral extends continuously through the batching chamber 6, which batching chamber 6 is externally delimited by a calibrated cylindrical wall 7 having a diameter which is just greater than the external diameter of the spiral 5, so that a seal against the loose material is created between the periphery of the spiral and the internal surface of the batching chamber 6. By taking into account the geometrical characteristics of the shaft 4, the spiral 5 and the batching chamber 6, and by regulating the rotation speed of the shaft 4, a desired delivery rate of loose material through the batching chamber 6 can be achieved. The mixer 1 comprises a mixing chamber 8 having a first inlet 9, connected to the batching chamber 6 in order to receive the batched loose material therefrom, a second inlet 10 for supply of at least one liquid product, and an outlet 11 for the mixed material. The mixing chamber 8 is delimited by a cylindrical wall 12 which is coaxial to the shaft 4.

The shaft 4 extends into the mixing chamber 8, but the spiral 5 is replaced by a plurality of radial agitator blades 13 for agitating the material. The radial agitator blades 13 are arranged impeller-fashion about the shaft 4.

Each agitator blade 13 comprises a first part 14 which is connected to the shaft 4 and extends prevalently in a radial direction (with reference to the axis of the shaft 4). This first part 14 has the task of penetrating the material. Each agitator blade 13 also has a second part 15, joined to the first part 14, which is situated at a predetermined radial distance from the shaft 4 and extends prevalently in a parallel direction to the shaft 4. The second part 15 has the function of homogenizing the material, and extends for half its length to the right and for the other half of its length to the left of the first part 14, with reference to the arrow F in the figures of the drawings.

Figure 4:
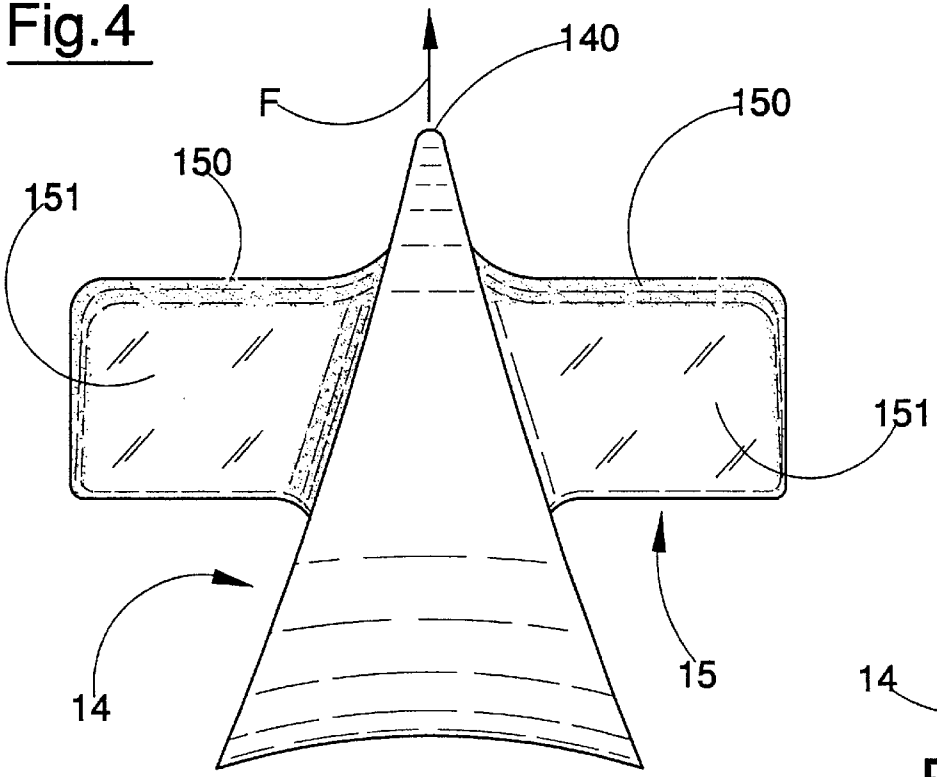
FIG. 4 is a view from above of FIG. 3.
Figure 5:
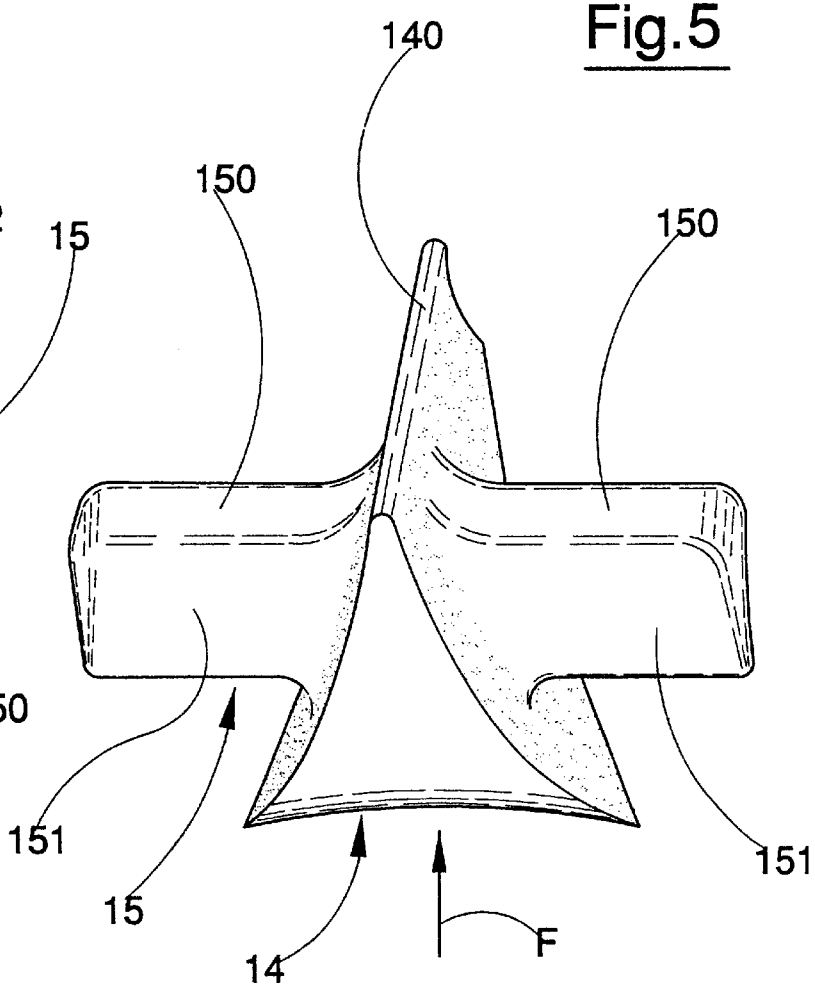
FIGS. 5 and 6 are two perspective views of the detail of FIGS. 3 and 4.
Figure 6:
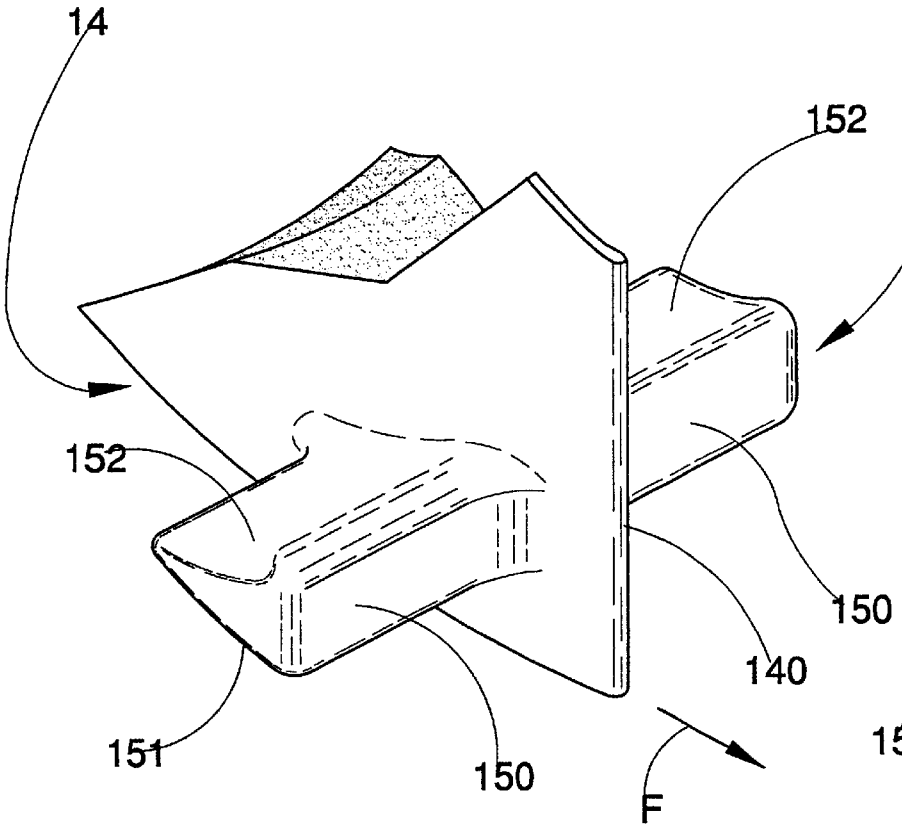

The first part 14 of each blade 13 is wedge-shaped in order to penetrate well into the material being mixed. The wedge shape of the first part 14 can clearly be seen in FIG. 4 or 5. The wedge exhibits a front end 140 which extends in length in radial direction. The transversal section of the first part 14 of the blades progressively increases from the centre towards the edge, in a radial direction with respect to the shaft 4 axis.

It has been observed that the radial part 14 of the blade being wedge-shaped, and the axial part 15 being prism-shaped, with a triangular base and a front side predisposed to impact frontally with the material to be mixed, together produce a combined effect which considerably improves the operative productivity of the mixer. Each blade 13 is symmetrical according to a plane which is perpendicular to the shaft 4 axis and which passes through the front end 140 of the wedge.

The second part 15 of each blade exhibits a frontal surface 150 (with reference to blade advancement direction F) which is destined to directly impact with the material during mixing, with a practically perpendicular direction of impact on the material. In the illustrated case, the front surface 150 is flat; it could, however, in the interests of improving the mix efficiency, be made slightly concave so as to exhibit at least a slightly recessed longitudinal central zone with respect to the two opposite longitudinal edges, external and internal respectively, further from or closer to the shaft 4 axis. The front surface 150 is located further back (again with reference to advancement direction F) with respect to the front end 140 of the wedge formed by the first part 14. At the centre, the front surface 150 is joined to the first part 14.

The second part 15 of each blade exhibits two surfaces, denoted by 151 and 152, respectively external and internal with respect to the central shaft 4, which two surfaces 151 and 152 are frontally joined respectively to the external and internal edges of the front surface 150, and posteriorly joined one to the other.

Figure 3:
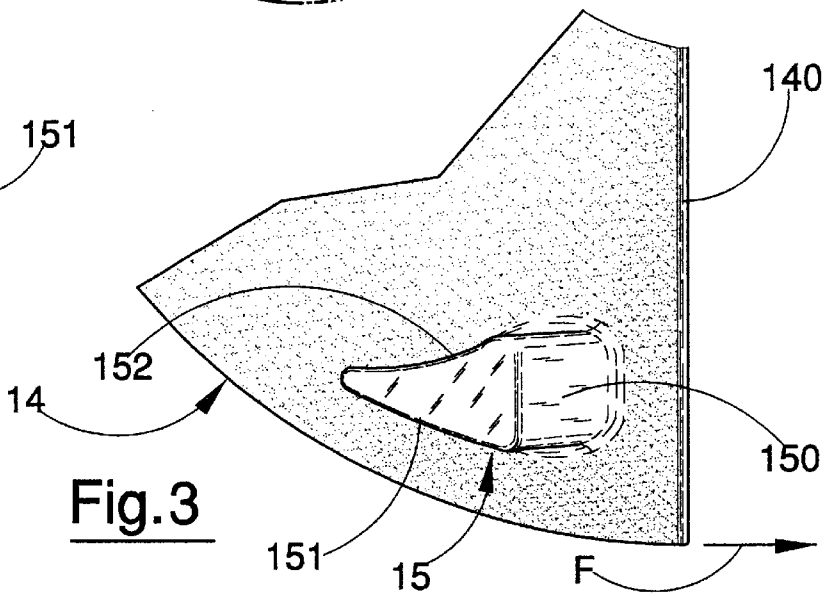
FIG. 3 is an enlarged detail of FIG. 2.

The external surface 151 is slightly convex, while the internal surface 152 is slightly concave. The second part 15 of each blade exhibits a narrowing of section in a backwards direction with reference to advancement direction F of the blade, as can be seen in FIG. 3.

The transversal section of the second part 15, which is practically constant, is approximately triangular, having a shorter side arranged frontally and two longer sides extending backwards. The shorter front side, which is parallel to the front end 140 of the wedge, is arranged perpendicular to blade advancement direction F so as to have a frontal impact with the material as it is being mixed in the mixing chamber 8.

The second part 15 of each blade is preferably located at about two-thirds along the overall length of the blade, starting from the blade connection with the shaft. This has been found to be the best position for the homogenizing action of the second part 15 of the blade.

Conformed and arranged in this way, it has been found that the blades 13 create a high degree of turbulence in the mixture of loose solid and liquid materials as they are mixing. In particular, the two parts 14 and 15 of each blade cooperate to increase considerably the effect of turbulence, with a consequently rapid and energetically efficient homogenization of the various components in the mixture.

What is claimed is:

1. A mixer comprising:

a mixing chamber having at least one inlet and an outlet for at least one material to be mixed;

a shaft located internally of the mixing chamber and bearing a plurality of radial blades for agitating the at least one material;

each of the plurality of radial blades comprising at least two parts, namely a first part and a second part joined to one another;

the first part extending substantially in a radial direction and being attached to said shaft, and the second part extending substantially in an axial direction and being situated at a predetermined radial distance from the shaft;

the first part being wedge-shaped and tapering, toward a blade advancement direction, to a thin-edged front end, in order to favor penetration thereof into the material;

the second part having a frontal surface and tapering therefrom, in a direction opposite the blade advancement direction, to a rear surface narrower than the frontal surface; and said frontal surface being substantially parallel with the thin-edged front end and spaced therefrom, said frontal surface directly impacting with the material during mixing.

2. The mixer of claim 1, wherein the second part is axially prism-shaped with a substantially triangular base and two sides extending from the frontal surface to the rear surface.

3. The mixer of claim 2, wherein the frontal surface is shorter than the two sides.

4. The mixer of claim 1, wherein the frontal surface is slightly concave so as to exhibit at least a slightly recessed longitudinal central zone with respect to two opposite longitudinal edges, external and internal respectively, further from and closer to the shaft axis.

5. The mixer of claim 1, wherein said predetermined radial distance is about two-thirds the radial length of each one of said plurality of radial blades.

* * * * *